US010335658B1

(12) United States Patent
Sharum

(10) Patent No.: US 10,335,658 B1
(45) Date of Patent: Jul. 2, 2019

(54) BASEBALL BAT CONTROL SYSTEM AND METHOD OF USE

(71) Applicant: Richard Sharum, Garland, TX (US)

(72) Inventor: Richard Sharum, Garland, TX (US)

( * ) Notice: Subject to any disclaimer, the term of this patent is extended or adjusted under 35 U.S.C. 154(b) by 0 days.

(21) Appl. No.: 15/608,382

(22) Filed: May 30, 2017

Related U.S. Application Data

(63) Continuation-in-part of application No. 15/429,499, filed on Feb. 10, 2017, now abandoned.

(51) Int. Cl.

| | |
|---|---|
| ***A63B 59/50*** | (2015.01) |
| ***A63B 60/12*** | (2015.01) |
| ***A63B 60/14*** | (2015.01) |
| *A63B 102/18* | (2015.01) |
| *A63B 59/59* | (2015.01) |
| *A63B 69/00* | (2006.01) |

(52) U.S. Cl.
CPC ..... *A63B 60/12* (2015.10); *A63B 59/50* (2015.10); *A63B 60/14* (2015.10); *A63B 2102/18* (2015.10)

(58) Field of Classification Search
CPC . A63B 69/0002; A63B 59/50; A63B 2102/18; A63B 2069/0008; A63B 60/14
USPC ..... 473/422, 457, 437, 568, 203, 523, 538, 473/552, 549
See application file for complete search history.

(56) References Cited

U.S. PATENT DOCUMENTS

| | | | | | |
|---|---|---|---|---|---|
| 1,822,212 | A * | 9/1931 | Griffiths | A63B 53/14 | 473/203 |
| 2,160,656 | A * | 5/1939 | Hall | A63B 53/14 | 473/203 |
| RE21,439 | E * | 4/1940 | Link | A63B 53/14 | 473/203 |
| 2,223,437 | A * | 12/1940 | Yeager, Jr. | A63B 53/007 | 473/206 |
| 2,437,404 | A * | 3/1948 | Robinson | A63B 53/14 | 473/203 |
| 3,256,023 | A * | 6/1966 | Frazelle | A63B 53/14 | 473/206 |
| 3,606,325 | A * | 9/1971 | Lamkin et al. | A63B 53/14 | 473/549 |
| 3,860,243 | A * | 1/1975 | Prisco, Sr. | A63B 69/3685 | 473/206 |
| 4,072,311 | A * | 2/1978 | Bertucci | A63B 49/08 | 473/551 |
| 4,185,375 | A * | 1/1980 | Brown | A63B 49/08 | 473/549 |
| 4,213,609 | A * | 7/1980 | Swanson | A63B 49/08 | 473/551 |
| 4,961,572 | A * | 10/1990 | Badillo | A63B 49/08 | 473/538 |
| 5,299,802 | A * | 4/1994 | Bouchet-Lassale | A63B 49/08 | 473/206 |
| 6,017,283 | A * | 1/2000 | Hagey | A63B 49/08 | 473/549 |
| 7,160,216 | B2 * | 1/2007 | Failla Colonnello Seppi | A63B 69/38 | 473/551 |

(Continued)

*Primary Examiner* — Mitra Aryanpour

(57) ABSTRACT

A control apparatus for securing to a handle, the control apparatus includes a shaped insert to removably attach to the handle; a sleeve to elastically secure to the handle, the sleeve having a tubular body; and a pocket extending from a bottom end of the tubular body; the pocket is to receive the shaped insert; the shaped insert alters a grip associated with the handle.

6 Claims, 8 Drawing Sheets

(56) References Cited

U.S. PATENT DOCUMENTS

| | | | | |
|---|---|---|---|---|
| 8,167,744 | B2 * | 5/2012 | Silvain | A63B 60/10 473/422 |
| 8,602,925 | B1 * | 12/2013 | Rickon, Jr. | A63B 60/12 473/203 |
| 2005/0202910 | A1 * | 9/2005 | Blount | A63B 60/12 473/568 |
| 2008/0015041 | A1 * | 1/2008 | Ryan | A63B 69/3632 473/213 |
| 2015/0367210 | A1 * | 12/2015 | Long | A63B 71/141 473/568 |

* cited by examiner

BASEBALL BAT CONTROL SYSTEM AND METHOD OF USE

BACKGROUND

1. Field of the Invention

The present invention relates generally to sporting equipment, and more specifically, to a baseball bat for hitting a baseball.

2. Description of Related Art

Sporting equipment is well known in the art and enables players to participate in games that require tools such as baseball, tennis, golf and the like. For example, FIG. 1 depicts a conventional baseball bat 101 having a cylindrical barrel 103 rigidly attached to a cylindrical grip 105. The grip 105 terminates at a knob 107 that extends radially outward from the grip 105 to ensure that a players hands do not slip off the bat. The player holds the bat by the grip and swings the barrel at a baseball.

One of the problems commonly associated with system 101 is its limited efficiency. For example, while hitting a baseball the player tries to control where the ball will go. The cylindrical shape of the grip reduces the force that a player can apply to the baseball bat to direct the ball out to the field.

Accordingly, although great strides have been made in the area of baseball bats, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
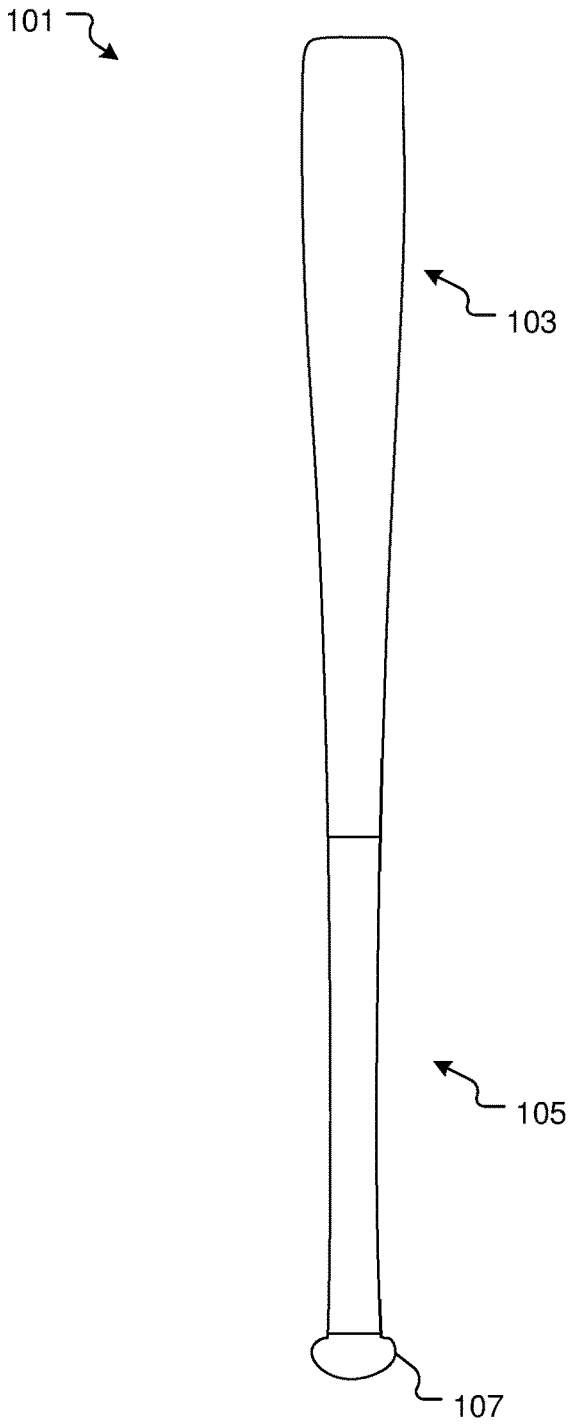
FIG. 1 (Prior Art)
FIG. 1 is a front view of a common baseball bat.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional baseball bats. Specifically, the system of the present application enables a player to add leverage to the grip to facilitate controlling the direction of a hit baseball. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
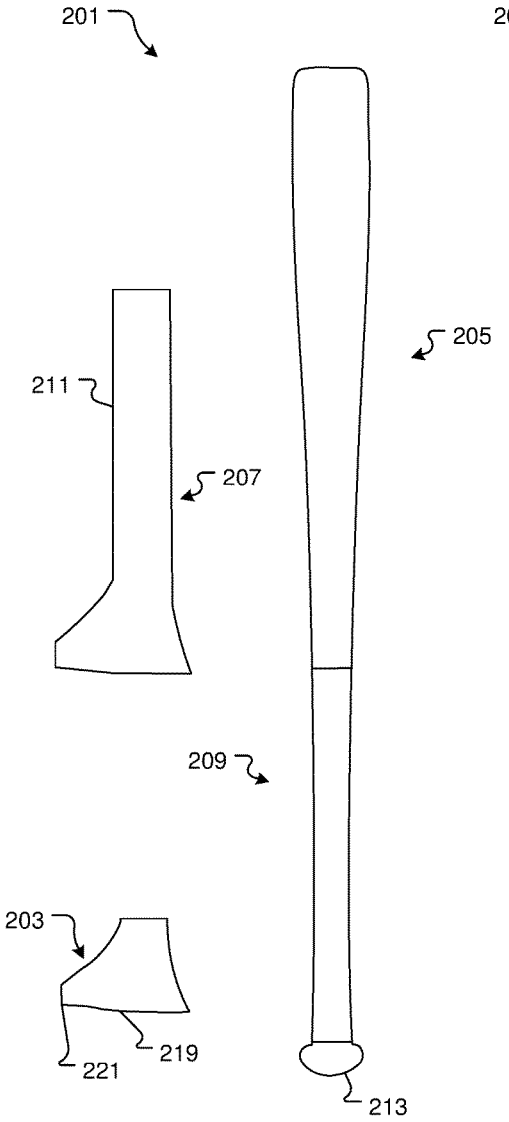
FIG. 2A illustrates a component view of a baseball bat control system in accordance with an aspect of the present application, and a front view of a bat.
Figure 2B:
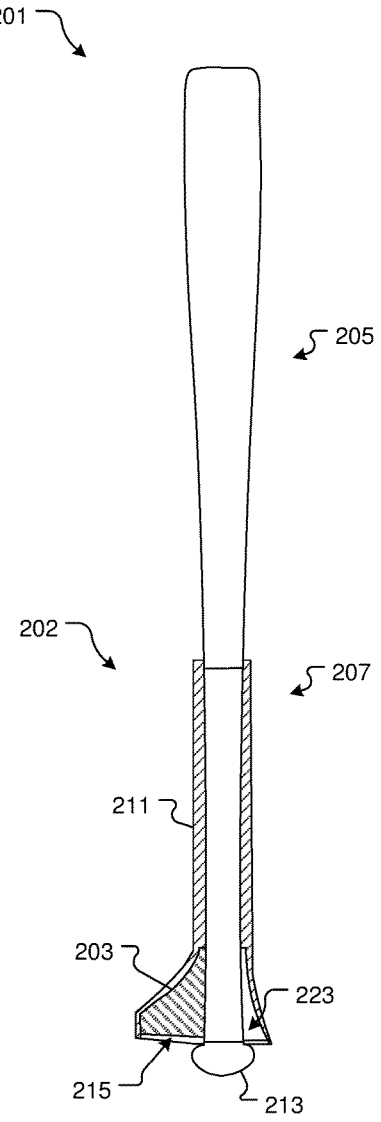
FIG. 2B illustrates a cross-sectional view of the baseball bat control system of FIG. 2A in accordance with aspects of the present application.

Referring now to the drawings wherein like reference characters identify corresponding or similar elements throughout the several views, FIGS. 2A and 2B depict a front view and a cross-sectional front view respectively of a baseball bat control system in accordance with a preferred embodiment of the present application. It will be appreciated that system 201 overcomes one or more of the above-listed problems commonly associated with conventional baseball bats.

In the contemplated embodiment, system 201 includes control apparatus 202 having a shaped insert 203 removably attached to the handle 209 of a baseball bat 205 via a sleeve 207. The sleeve 207 is elastically attached to the handle 209 of the baseball bat 207. It should be appreciated that although control apparatus 202 is shown in use with a baseball bat, alternative devices with similar handles are contemplated to be altered via the control apparatus 202.

The sleeve 207 having a body 211 configured to slide over the knob 213 of the baseball bat. The sleeve also having a pocket 215 within the interior of the body 211 configured to hold a shaped insert 203 above the knob 213 and against the handle 209 of the baseball bat 205. It is contemplated and will be appreciated that body 211 of sleeve 207 could be made from a material that also improves the grip of the players hands around sleeve 207. It should be appreciated that shaped insert 203 can vary in dimensions as desired for functional or manufacturing considerations.

The shaped insert 203 having a body 219 with at least one protrusion 221 that alters the grip of the handle 209 of the baseball bat 205. The body 219 also has a cutout 223 that conforms to the handle 209 and assists the sleeve 207 in holding the shaped insert 203 against the handle 209.

It should be appreciated that one of the unique features believed characteristic of the present application is that the protrusion 221 of the shaped insert 203 enables the player to apply additional force to the baseball bat 205 by providing additional leverage. Additionally the shaped insert 203 facilitates the player maintaining their hands in the proper position during the complete swing of the baseball bat 205.

Figure 3:
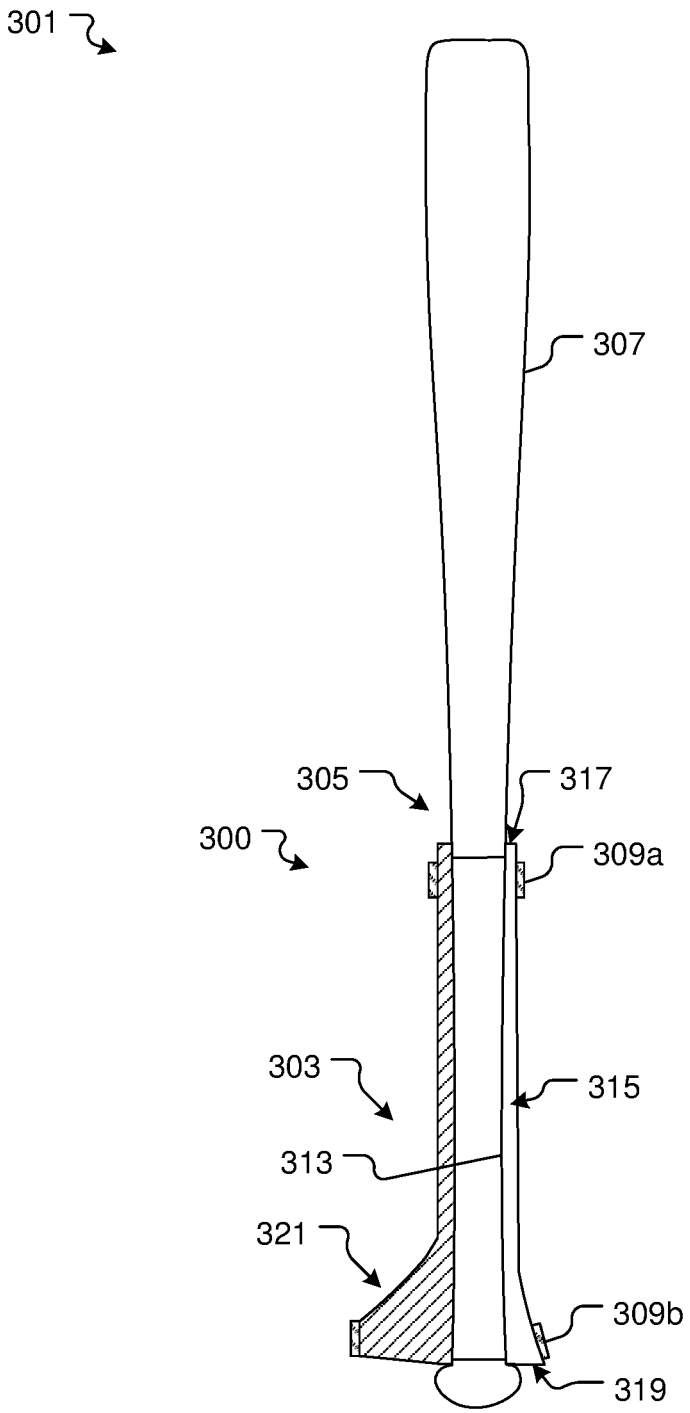
FIG. 3 is a cross-sectional view of a baseball bat control system according to an aspect of the present application.

Referring now to FIG. 3, an alternative embodiment of a control system 301 is depicted. Embodiment 301 including a control apparatus 300 having a body 303 removably attached to the handle 305 of a baseball bat 307 by a plurality of bands 309*a-b*.

The body 303 having a cylindrical cavity 313 that fits around the handle 305 of the baseball bat 307. The body 303 can have a break 315 from the top end 317 to the bottom end 319 of the body 303 that enables the apparatus 300 to be attached to the baseball bat 307. The body 303 is made of a material that allows the apparatus 300 to flex open to fit around the baseball bat 307. The body having at least one protrusion 321 integral to and extending outward from the body 311 that alters the shape of the grip associated with handle 305. It is contemplated and will be appreciated that apparatus 300 could be attached to the grip by adhesive, fasteners or the like without the use of bands 309.

Figure 4:
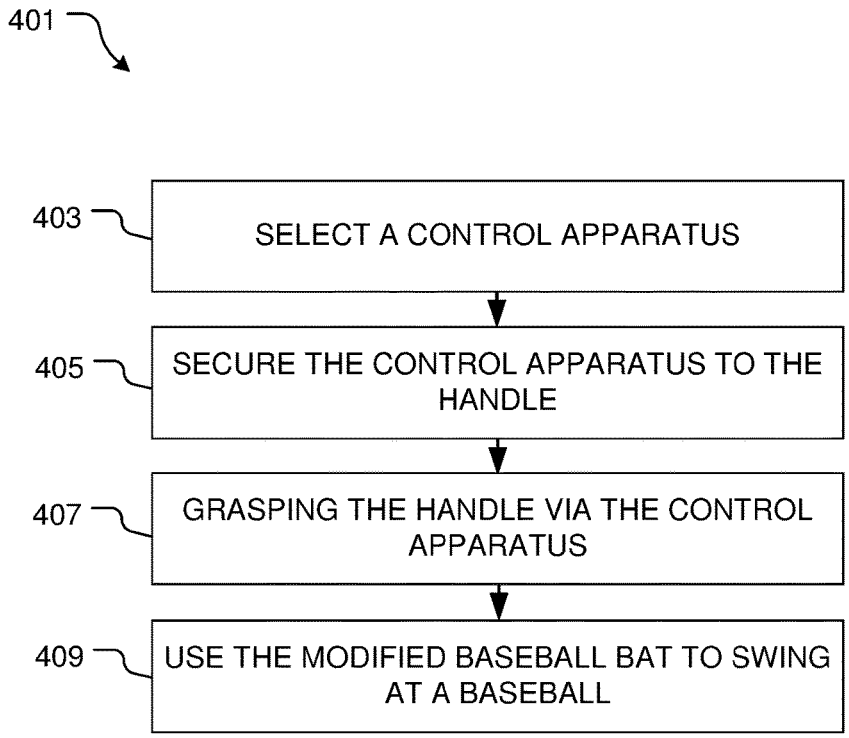
FIG. 4 is a flowchart of a preferred method of use of a baseball bat control system according to the present disclosure.

Referring now to FIG. 4, the preferred method of use of the system 201 is depicted. Method 401 including selecting a control apparatus, securing the control apparatus to a handle of a baseball bat (or other similar device), wherein the control apparatus alters the shape of the grip associated with the baseball bat, as shown with boxes 403, 405. The baseball bat handle is grasped and used to swing the baseball bat (or other similar device), as shown with boxes 407, 409.

Figure 5:
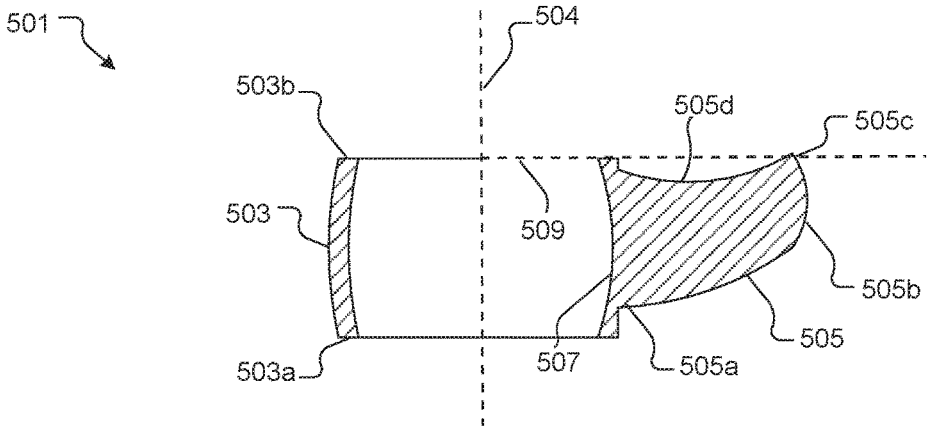
FIG. 5 is a cross-sectional side view of an alternative embodiment of a control apparatus in accordance with the present application.

Referring now to FIG. 5 an alternative embodiment of a control apparatus 501 is depicted. Embodiment 501 includes a sleeve body 503 with an inner cavity 507 configured to fit around the knob of a baseball bat. As illustrated in FIG. 5, the sleeve body 503 extends along an axis 504 from a first end 503*a* to a second end 503*b*. The sleeve body 503 also having a protrusion 505 extending away from the sleeve body 503 from a proximal end 505*a* at the sleeve body 503, to a distal end 505*b* that defines a distal tip 505*c*. The protrusion 505 defining a surface 505*d* between the proximal end 505*a* and the distal tip 505*c* whereupon the hand and fingers of the user rest during use. In the embodiment 501 the protrusion 505 extends away from the sleeve body 503 at about 90 degrees. As indicated by reference line 509, the protrusion 505 extends away from the sleeve body 503 and defines a shape such that, the distal tip 505*c* extends past the first end 503*a* and is at least level with the second end 503*a* of the sleeve body 503 along the axis 504.

In the embodiment 501 the protrusion 505 extends away from the sleeve body 503 at about 90 degrees. It should be appreciated that embodiment 501 is configured to function in a same or similar fashion to the control apparatus of system 201 by altering a grip associated with a handle of a baseball bat (or other similar device). Protrusion 505 provides a means of adding additional leverage to the baseball bat by the user.

It is contemplated that the sleeve body 503 is composed of an elastic material to slide over the knob of the baseball bat. It will be understood that although an elastic sleeve body 503 is contemplated other means of attaching the embodiment 501 to a baseball are also contemplated.

Figure 6:
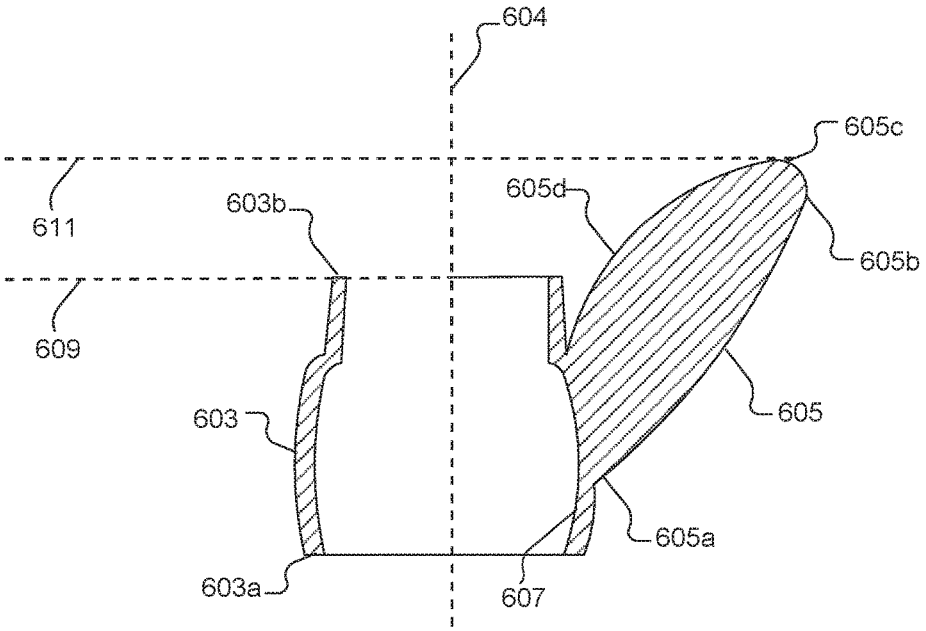
FIG. 6 is a cross-sectional side view of an alternative embodiment of a control apparatus in accordance with the present application.

Referring now to FIG. 6, an alternative embodiment 601 having the same features as embodiment 501 is depicted. Embodiment 601 includes a sleeve body 603 with an inner cavity 607 configured to fit around the knob of a baseball bat. As illustrated in FIG. 6, the sleeve body 603 extends along an axis 604 from a first end 603*a* to a second end 603*b*. The sleeve body 603 also having a protrusion 605 extending away from the sleeve body 603 from a proximal end 605*a* at the sleeve body 603, to a distal end 605*b* that defines a distal tip 605*c*. The protrusion 605 defining a surface 605*d* between the proximal end 605*a* and the distal tip 605*c* whereupon the hand and fingers of the user rest. In the current embodiment 601 the protrusion 605 extends away from the sleeve body 603 at about 45 degrees. FIG. 6 illustrates a first reference line 609 and a second reference line 611 that correspond, respectively, to locations along the axis 604 of the second end 603*b* of the sleeve body 603 and the distal tip 605*c* of the protrusion 605. As illustrated by the first and second reference lines 609, 611, the distal tip 605*c* extends past the first end 603*a* and the second end 603*b* of the sleeve body 603 along the axis 604. Accordingly, the protrusion 605 extends past a location that is at least level with the second end 603*b* of body 603 along the axis 604. It should be appreciated that the protrusions can vary in size and dimensions as desired by aesthetical, function, or manufacturing considerations require.

Figure 7:
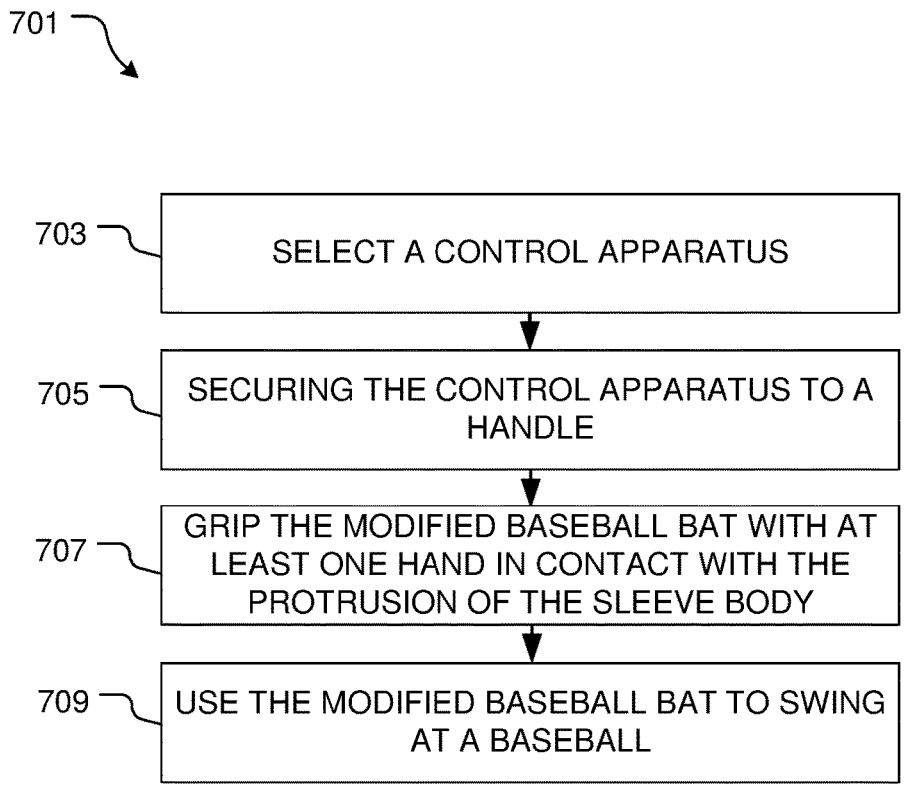
FIG. 7 is a flowchart of the preferred method of use of the apparatuses of FIGS. 5 and 6.

The preferred method of using the control apparatuses 501 and 601 are depicted in FIG. 7. Method 701 including selecting the desired control apparatus and securing the selected control apparatus to the handle of a baseball bat (or similar device), as shown with boxes 703, 705. The user can then grip the modified baseball bat with at least one hand in contact with the protrusion of the sleeve body and use the baseball bat to swing at a baseball, as shown with boxes 707, 709.

Figure 8:
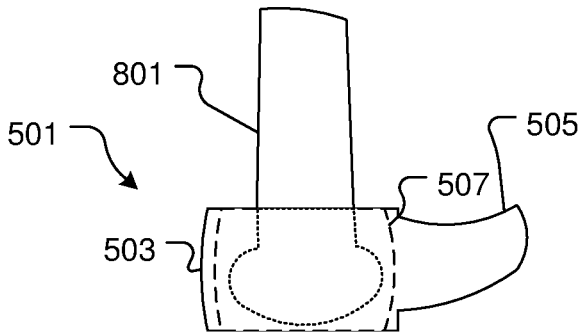
FIG. 8 is a front view of the control apparatus of FIG. 5 secured to a baseball bat.
Figure 9:
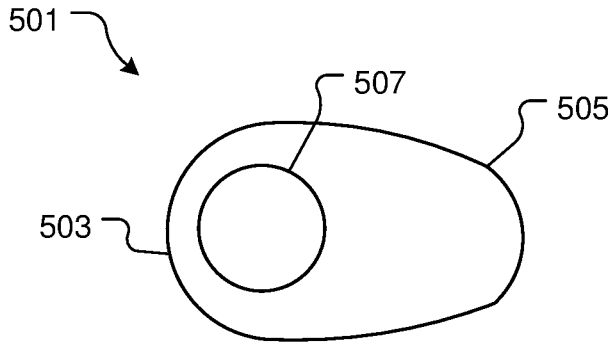
FIG. 9 is a top view of the control apparatus of FIG. 5.

FIG. 8 depicts a front view of control apparatus 501 secured to a bat 801, wherein the knob of bat 801 is secured within the cavity 507 of apparatus 501. FIG. 9 depicts a top view of apparatus 501, further demonstrating the features discussed above in connection with FIG. 5. It should be appreciated that apparatus 501 is composed of a flexible material, thereby allowing for cavity 507 to receive bat 801 securely.

Figure 10A:
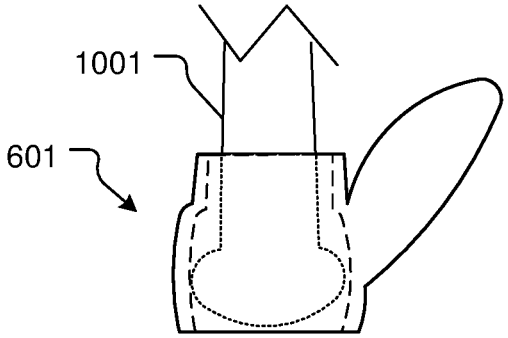
FIGS. 10A and 10B are front views of the control apparatus of FIG. 6 secured to a baseball bat.
Figure 10B:
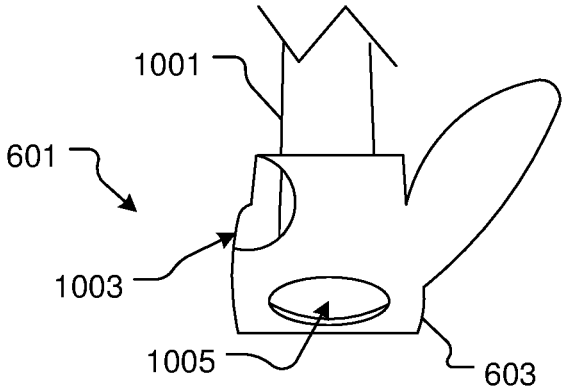

In FIGS. 10A and 10B, front views depicts apparatus 601 secured to a bat 1001. FIG. 10A demonstrates how the knob of bat 1001 fits within the inner cavity of apparatus 601 and FIG. 10B demonstrates the exterior of body 603, wherein body 603 can include one or more cut outs 1003, 1005 thereby providing greater flexibility in body 603, allowing for securement of apparatus 601 to bat 1001.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A control apparatus for securing to a handle, the control apparatus comprising:

a sleeve body that extends along an axis from a first end to a second end and is configured to removably attach to the handle, the sleeve body having:

an inner cavity for receiving the handle;

at least one protrusion extending away from the sleeve body from a proximal end at the sleeve body to a distal end that defines a distal tip;

wherein the distal tip extends past the first end and is at least level with the second end of the sleeve body along the axis;

wherein the sleeve body is elastic, thereby allowing flexibility for securing the sleeve body to the handle;

wherein the sleeve body alters a grip associated with the handle via the at least one protrusion; and wherein the at least one protrusion provide leverage associated with the handle.

2. The apparatus of claim 1, wherein the at least one protrusion extends away from the sleeve body at 90 degrees.

3. The apparatus of claim 1, wherein the at least one protrusion extends away from the sleeve body at 45 degrees.

4. The apparatus of claim 1, wherein the sleeve body is configured to secure over a baseball bat knob.

5. The apparatus of claim 1, wherein the handle is associated with a baseball bat.

6. A method of altering a grip of a handle, the method comprising:

providing a control apparatus configured to removably secure to the handle, the control apparatus comprising:

a sleeve body that extends along an axis from a first end to a second end and is configured to removably attach to the handle, the sleeve body having:

an inner cavity for receiving the handle;

at least one protrusion extending away from the sleeve body from a proximal end at the sleeve body to a distal end that defines a distal tip;

wherein the sleeve body is elastic, thereby allowing flexibility for securing the sleeve body to the handle;

securing the control apparatus to the handle such that the distal tip extends past the first end and is at least level with the second end of the sleeve body along the axis;

grasping the handle with one or more hands;

wherein the sleeve body alters a grip associated with the handle via the at least one protrusion; and wherein the at least one protrusion provides leverage associated with the handle; and controlling movement of the handle.

* * * * *